United States Patent [19]

Klepp et al.

[11] 3,947,154

[45] Mar. 30, 1976

[54] PUMP ASSEMBLY FOR CIRCULATION OF COOLANT IN BOILING WATER REACTORS OR THE LIKE

[75] Inventors: Christian Klepp, Frankenthal; Günter Koll, Frankenthal-Studernheim; Waldemar Schwartz, Hessheim, all of Germany

[73] Assignee: Klein, Schanzlin & Becker Aktiengesellschaft, Frankenthal, Palatinate, Germany

[22] Filed: June 11, 1974

[21] Appl. No.: 478,393

[30] Foreign Application Priority Data

June 19, 1973 Germany ..... 2331039

[52] U.S. Cl. ..... 417/373; 415/112; 415/178; 417/372; 417/424

[51] Int. Cl.[2] ..... F04B 39/06

[58] Field of Search ..... 415/112, 175, 178; 417/424, 373, 372

[56] References Cited

UNITED STATES PATENTS

| | | | |
|---|---|---|---|
| 2,730,954 | 1/1956 | Hornschuch | 415/178 |
| 2,764,943 | 10/1956 | Peters | 417/372 |
| 2,885,963 | 5/1959 | Ivanoff | 417/372 |
| 3,394,659 | 7/1968 | Van Alen | 417/373 |
| 3,476,488 | 11/1969 | Chambert | 415/219 C |
| 3,478,689 | 11/1969 | Ball | 415/158 |
| 3,652,179 | 3/1972 | Hagen | 415/112 |

FOREIGN PATENTS OR APPLICATIONS

| | | | |
|---|---|---|---|
| 1,132,115 | 10/1956 | France | 417/373 |
| 1,151,742 | 5/1969 | United Kingdom | 417/424 |
| 854,165 | 11/1960 | United Kingdom | 417/373 |
| 1,017,202 | 9/1952 | France | 417/424 |

*Primary Examiner*—C. J. Husar
*Attorney, Agent, or Firm*—Michael J. Striker

[57] ABSTRACT

A pump assembly for circulation of liquid coolant in boiling water reactors has a thin-walled spherical pump body for an impeller which rotates about a vertical axis and an electric motor which drives the impeller and has an upright housing with a heat barrier at its upper end. The heat barrier has a thin-walled neck portion which surrounds the impeller shaft below an opening in the lower part of the pump body and a ring-shaped surface which is biased against a complementary surface of the pump body around the opening by several heat-expansible bolts which separably couple the housing to the pump body. The heat barrier has an annular air space surrounding the neck portion and being surrounded by an annulus of cooling ribs, an upper flange which abuts against the pump body and has one or more compartments for a circulating coolant, and a lower flange with one or more compartments for a circulating coolant. The area of contact between the surfaces of the pump body and the upper flange of the heat barrier is small so that the heat barrier prevents excessive transfer of heat between the pump body and the motor housing.

6 Claims, 1 Drawing Figure

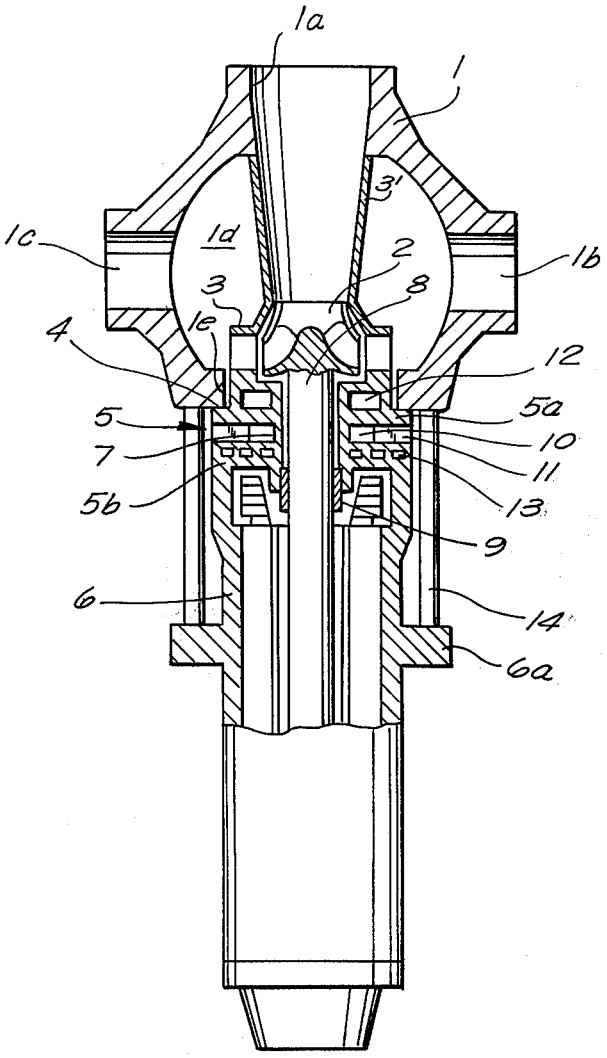
1a
1
3'
1c
1d
2
1b
3
8
1e
4
12
5
5a
7
10
11
5b
13
9
6
14
6a

PUMP ASSEMBLY FOR CIRCULATION OF COOLANT IN BOILING WATER REACTORS OR THE LIKE

BACKGROUND OF THE INVENTION

The invention relates to pump assemblies or aggregates in general, and more particularly to improvements in assemblies wherein a preferably glandless motor drives the impeller of a centrifugal pump. Such pump assemblies can be used for circulation of fluids which are maintained at an elevated pressure and/or temperature, for example, to recirculate water in boiling water reactors.

It is already known to drive a vertically mounted recirculating pump by a glandless motor whose output member rotates the impeller of the pump. It is also known to provide in such assemblies a barrier serving to interfere with the transfer of heat from the pump to the motor which latter is normally mounted at a level below the pump. A drawback of presently known assemblies of the above outlined character is the complexity of heat barrier, high initial and maintenance cost, and excessive transfer of heat between the pump and motor.

SUMMARY OF THE INVENTION

An object of the invention is to provide a pump assembly which is particularly suited for circulation of highly pressurized liquid coolant in nuclear reactors, such as boiling water reactors, and which is provided with novel and improved means for preventing excessive transfer of heat between the body of the pump and the housing of the prime mover which drives the impeller of the pump.

Another object of the invention is to provide a novel and improved heat barrier between the body of a centrifugal pump which is used to circulate liquids at elevated temperatures and the housing of a glandless electric motor which drives the impeller in the pump body.

A further object of the invention is to provide a novel and improved separable coupling between the housing of an electric motor and the body of a pump whose impeller is driven by the motor.

An additional object of the invention is to provide a pump assembly which can be readily and rapidly assembled or taken apart, which can be used as a superior substitute for presently known pump assemblies in boiling water reactors or the like, and which prevents leakage of fluid between the pump body and the motor housing even if the temperature of fluid which is being conveyed or circulated by the pump fluctuates within a wide range.

The invention resides in the provision of a pump assembly which is especially suited for circulation of highly pressurized fluids whose temperature fluctuates within a wide range. The assembly comprises a pump including a preferably spherical and preferably thin-walled hollow pump body provided with an opening and a first surface surrounding the opening, and a rotary impeller in the pump body, and a prime mover (preferably a glandless electric motor) including a rotary output member which rotates the impeller and a motor housing having a second surface which sealingly engages the first surface whereby the area of contact between the two surfaces is held to a minimum. The housing of the prime mover includes a specially designed heat barrier which is adjacent to the first surface and includes the second surface; this heat barrier comprises a thin-walled annular neck portion surrounding a portion of the output member and being preferably surrounded by one or more air spaces within an annulus of cooling ribs. The heat barrier preferably further comprises one or more compartments for a circulating coolant, and such compartments may be disposed at both axial ends of the neck portion whereby at least one compartment preferably extends into the opening of the pump body. The pump assembly further comprises steel bolts or other suitable biasing means for urging the two surfaces against each other; such bolts are preferably expansible and contractible in response to heating or cooling to thus compensate for changes in the temperature of fluid which is being conveyed or circulated by the pump and which heats or cools the pump body.

The motor may be installed at a level below the pump body and may constitute with the impeller and/or certain other parts a prefabricated unit or module which is detachable from the pump body in response to disengagement of bolts from the pump body.

The novel features which are considered as characteristic of the invention are set forth in particular in the appended claims. The improved pump assembly itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is an axial sectional view of a pump assembly with glandless motor which embodies the invention.

DESCRIPTION OF THE PREFERRED EMBODIMENTS

The pump assembly which is shown in the drawing comprises a preferably spherical or substantially spherical cast or forged pump housing or body 1 having an inlet 1*a* and outlets 1*b*, 1*c*. The inlet 1a admits inflowing fluid into a conical suction pipe 3' which directs the fluid into the range of a rotary impeller 2 mounted at the upper end of a vertical output member or shaft 8. The impeller 2 is surrounded by an annulus of guide vanes 3 between which the fluid is caused to flow into a pressure chamber 1*d* on its way into the outlets 1*b*, 1*c*.

The prime mover which rotates the pump shaft 8 is a glandless electric motor having a housing 6 provided with an external collar 6*a*. The means for separably coupling the housing 6 to the body 1 and for biasing the housing against the pump body comprises several expansible threaded bolts 14 whose heads engage the collar 6*a* and whose upper end portions extend into tapped bores of the body 1. The bolts 14 may consist of steel or another metallic material which can expand sufficiently in response to temperature changes to prevent leakage of fluid through the opening 1e in the lower part of the pump body 1. A portion of the shaft 8 rotates in a sleeve bearing 9 which is mounted in the upper portion 5 of the motor housing 6.

The upper portion 5 of the motor housing 6 constitutes a heat barrier and has a thin-walled annular neck portion 7 above the bearing 9. The neck portion 7 is surrounded by a ring-shaped air-filled space 10 which, in turn, is surrounded by an annulus of radially extending cooling ribs 11 disposed between an upper flange 5*a* and a lower flange 5*b* of the housing portion 5. The upper flange 5*a* has an extension which projects into the opening 1e in the lower portion of the pump body 1 and is formed with one or more compartments 12 for a circulating cooling fluid, e.g., water. The lower flange 5*b* is formed with several compartments 13 which also receive a circulating coolant so that the housing portion 5 is cooled above as well as below the thin neck portion 7.

The pump body 1 has a flat ring-shaped surface 4 which surrounds the opening 1*e* and is in abutment with a complementary surface at the marginal portion of the upper flange 5*a*. The described surfaces cooperate to seal the interior of the pump body 1 from the atmosphere. The area of that portion of the surface 4 which abuts against the flange 5*a* is small to thus reduce the transfer of heat between the pump body 1 and the housing 6. Such transfer of heat is also limited owing to the thinness of the neck portion 7, owing to the provision of cooling space 10 and ribs 11 around the neck portion 7, and owing to the provision of cooling compartments 12, 13 in the flanges 5*a*, 5*b* above and below the neck portion 7.

The impeller 2, guide vanes 3, suction pipe 3′, shaft 8 and the motor including the housing 6 are assembled into a prefabricated unit or module which is thereupon coupled to the pump body 1 by bolts 14 so that the extension of the flange 5*a*, the impeller 2, the vanes 3, the pipe 3′ and a portion of the shaft 8 extend into the pump body 1 and the surface at the marginal portion of the flange 5*a* sealingly engages the surface 4.

The bolts 14 replace conventional flange couplings which are normally employed to secure the motor housing to the pump body. It has been found that, by reducing the area of contact between the pump body 1 and the flange 5a to a minimum, and also by reducing the thickness of the neck portion 7 to a minimum, the transfer of heat between the pump and the motor is reduced to a fraction of heat transfer in heretofore known pump assemblies with glandless motors. Additional reduction of heat transfer can be achieved by reducing the wall thickness of the motor housing 6 and by the aforedescribed construction of the housing portion 5 (with air space 10, ribs 11 and coolant-containing compartments 12, 13). A spherical or substantially spherical pump body 1 exhibits the advantage that it can stand extremely high stresses even though its wall thickness is much less than the wall thickness of cylindrical or otherwise configurated pump bodies.

The improved pump assembly exhibits a number of important advantages. Thus, the aforementioned prefabricated unit including the motor, pump shaft, guide vanes, suction pipe and impeller can be rapidly attached to or detached from the pump body. The exterior of the entire motor is accessible for inspection of its surfaces, the overall weight of the assembly is small (especially when considering the pressures which the assembly must withstand in actual use,) the sealing action between the pump body and motor housing is reliable even if the temperature and/or pressure of fluid in the pump body fluctuates within a very wide range, and that portion of the shaft which extends beyond the bearing is relatively short so that the diameter of this shaft can be small to thereby further reduce the transfer of heat between the pump and motor.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

We claim:

1. A pump assembly, particularly for circulation of highly pressurized fluids whose temperature fluctuates within a wide range, comprising a pump including a body having an opening and a first surface surrounding said opening, and a rotary impeller in said body; a glandless electric motor including a rotary output member for rotating said impeller and a housing having a second surface sealingly engaging said first surface, the area of contact between said surfaces being small and said housing including a heat barrier adjacent to said first surface and having a thin-walled neck portion surrounding said output member, an air-filled space surrounding said neck portion, cooling ribs surrounding said space and coolant-containing compartments at both sides of said space; and elongated expansible coupling elements connected to said body and said housing for biasing said surfaces against each other.

2. A pump assembly as defined in claim 1, wherein said output member is rotatable about a substantially vertical axis and said body and said housing are located at different levels.

3. A pump assembly as defined in claim 1, wherein at least one of said compartments is located in the interior of said body.

4. A pump assembly as defined in claim 1, wherein said body is a hollow sphere.

5. A pump assembly as defined in claim 1, wherein said coupling elements are expansible bolts separably connecting said housing to said body, said motor and said impeller forming part of a module which is separable from said body in response to disengagement of said bolts from said body and said module further comprising a suction pipe located in said body and arranged to convey fluid to be circulated into the range of said impeller.

6. A pump assembly as defined in claim 1, wherein said heat barrier further includes two flanges disposed at the opposite axial ends of said neck portion, said second surface being provided on one of said of said flanges and each of said flanges having at least one coolant-containing compartments.

* * * * *